US011516614B2

(12) United States Patent
Lee et al.

(10) Patent No.: US 11,516,614 B2
(45) Date of Patent: Nov. 29, 2022

(54) GENERATING SOUND ZONES USING VARIABLE SPAN FILTERS

(71) Applicant: Huawei Technologies Co., Ltd., Shenzhen (CN)

(72) Inventors: Taewoong Lee, Aalborg (DK); Jesper Kjaer Nielsen, Aalborg (DK); Jesper Rindom Jensen, Aalborg SØ (DK); Mads Graesbøll Christensen, Dronninglund (DK)

(73) Assignee: Huawei Technologies Co., Ltd., Shenzhen (CN)

( * ) Notice: Subject to any disclaimer, the term of this patent is extended or adjusted under 35 U.S.C. 154(b) by 24 days.

(21) Appl. No.: 17/047,144

(22) PCT Filed: Apr. 12, 2019

(86) PCT No.: PCT/DK2019/050116
§ 371 (c)(1),
(2) Date: Oct. 13, 2020

(87) PCT Pub. No.: WO2019/197002
PCT Pub. Date: Oct. 17, 2019

(65) Prior Publication Data

US 2021/0235213 A1 Jul. 29, 2021

(30) Foreign Application Priority Data

Apr. 13, 2018 (DK) ..... PA 2018 70221

(51) Int. Cl.
*H04R 5/02* (2006.01)
*H04S 7/00* (2006.01)
(Continued)

(52) U.S. Cl.
CPC ..... *H04S 7/301* (2013.01); *H04R 5/02* (2013.01); *H04R 5/04* (2013.01); *H04S 3/008* (2013.01);
(Continued)

(58) Field of Classification Search
CPC combination set(s) only.
See application file for complete search history.

(56) References Cited

U.S. PATENT DOCUMENTS 5,703,955 A * 12/1997 Fels ..... H04S 7/30 381/1
9,392,390 B2 7/2016 Olsen et al.
(Continued)

FOREIGN PATENT DOCUMENTS

DE 102013221127 A1 4/2015
EP 2755405 A1 7/2014

OTHER PUBLICATIONS

Lee et al., "A Unified Approach to Generating Sound Zones Using Variable Span Linear Filters," 2018 IEEE International Conference on Acoustics, Speech and Signal Processing (ICASSP), pp. 491-495, Institute of Electrical and Electronics Engineers, New York, New York (Apr. 15-20, 2018).
(Continued)

*Primary Examiner* — Duc Nguyen
*Assistant Examiner* — Assad Mohammed
(74) *Attorney, Agent, or Firm* — Leydig, Voit & Mayer, Ltd.

(57) ABSTRACT

The invention provides a method for generating output filters to a plurality of loudspeakers at respective positions for playback of a plurality of different input signals in respective spatially different sound zones by means of a processor system. The method comprising computing spatio-temporal correlation matrices in response to spatial infor-
(Continued)

mation, e.g. measured transfer functions, and in response to desired sound pressures in the plurality of sound zones. Joint eigenvalue decomposition of the spatial correlation matrices are then computed, or at least an approximation thereof, to arrive at eigenvectors accordingly. Next, variable span filters a reformed from a linear combination of the eigenvectors in response to a desired trade-off between acoustic contrast and acoustic errors in the sound zones. Finally, output filter for each of the plurality of loudspeakers, for each of the plurality of input signals, in accordance with the variable span filters. The method is applicable also for optimization in one zone, e.g. for room equalization.

20 Claims, 3 Drawing Sheets

(51) Int. Cl.
*H04R 5/04* (2006.01)
*H04S 3/00* (2006.01)

(52) U.S. Cl.
CPC ..... *H04S 2400/01* (2013.01); *H04S 2400/15* (2013.01)

(56) References Cited

U.S. PATENT DOCUMENTS 9,711,131 B2 7/2017 Christoph
9,813,804 B2 11/2017 Franck et al.
10,080,088 B1 * 9/2018 Yang ..... H04S 7/30
2006/0269072 A1 * 11/2006 Mao ..... H04R 29/005 381/56
2009/0222272 A1 * 9/2009 Seefeldt ..... G10L 19/008 704/E21.001
2013/0259238 A1 * 10/2013 Xiang ..... H04S 7/303 381/17
2014/0072142 A1 * 3/2014 Nakadai ..... H04R 1/32 381/92
2014/0214418 A1 * 7/2014 Nakadai ..... G10L 21/0216 704/233
2014/0348354 A1 * 11/2014 Christoph ..... H04S 7/307 381/303
2015/0043736 A1 2/2015 Olsen et al.

OTHER PUBLICATIONS

Jensen et al., "Noise Reduction with Optimal Variable Span Linear Filters," IEEE/ACM Transactions on Audio, Speech, and Language Processing, vol. 24, No. 4, pp. 631-644, Institute of Electrical and Electronics Engineers, New York, New York (Apr. 2016).
Gauthier et al., "Generalized singular value decomposition for personalized audio using loudspeaker array," 2016 AES International Conference on Sound Field Control, Total 79 pages, Guildford, UK (Jul. 2016).
Benesty et al., "Signal Enhancement with Variable Span Linear Filters," Springer Topics in Signal Processing, vol. 7, Total 176 pages, Springer (2016).
Gauthier et al., "Generalized Singular Value Decomposition for Personalized Audio Using Loudspeaker Array" AES Conference on Sound Field Control, Guildford, UK, Jul. 18-20, 2016, 10 pages.
Jensen et al., "Noise Reduction with Optimal Variable Span Linear Filters", IEEE/ACM Transactions on Audio, Speech, and Language Processing, vol. 24, No. 4, Apr. 2016, pp. 631-644.
Lee et al., "A Unified Approach to Generating Sound Zones Using Variable Span Linear Filters", 2018 IEEE, International Conference on Acoustics, Speech and Signal Processing (ICASSP), Apr. 15, 2018, pp. 491-495.
International Search Report and Written Opinion issued in PCT/DK2019/050116, dated Jul. 9, 2019.

* cited by examiner

GENERATING SOUND ZONES USING VARIABLE SPAN FILTERS

CROSS-REFERENCE TO RELATED APPLICATIONS

This application is the National Stage of International Patent Application No. PCT/DK2019/050116 "Generating Sound Zones Using Variable Span Filters" (filed Apr. 12, 2019), which claims priority to Danish Patent Application No. PA 2018 70221 (filed Apr. 13, 2018). The foregoing applications are incorporated herein by reference in their entireties for any and all purposes.

FIELD OF THE INVENTION

The present invention relates to the field of audio, specifically to the field of spatially selective audio reproduction. More specifically, the invention provides a method for generating multiple sound zones in a room, so as to allow persons to listen to different sound sources simultaneously at different locations in the room.

BACKGROUND OF THE INVENTION

E.g. in a car or in a living room where persons share one room and still want their own sound zones in the room with their different sound, e.g. listening to different sound sources. This requires a complex signal processing for controlling a set of loudspeakers to obtain a high degree of acoustic difference between the sound zones. With a limited number of loudspeakers, it is necessary to make a compromise between obtained sound quality and the obtained degree of acoustic difference between the sound zones necessary.

Pressure matching (PM) algorithms and Acoustic Contrast Control (ACC) algorithms are knows ways of generating sound zones. PM algorithms minimize acoustic reproduction error, whereas acoustic contrast between sound zones is not considered. On the contrary, ACC algorithms optimize acoustic contrast only, which, under various conditions, can lead to significant distortion of the desired signals.

In U.S. Pat. No. 9,813,804 B2 it has been proposed to calculate a masking threshold as a function of the version of the audio signal that is to be separated from the one or several other audio signals in one zone and controlling a beam forming processor for controlling outputs to a plurality of loudspeakers accordingly.

Still, it remains a problem how to provide a signal processing method which is capable of handling a scalable compromise or trade-off between sound quality and obtained acoustic contrast between the sound zones, if a limited number of loudspeakers are available.

SUMMARY OF THE INVENTION

Thus, according to the above description, it may be seen as an object of the present invention to provide a method for generating sound zones which allows a scalable control of sound quality and acoustic contrast between the sound zones which is suitable for signal processing also in case of a limited number of loudspeakers.

In a first aspect, the invention provides a method for generating output filters to a plurality of loudspeakers at respective positions for playback of a plurality of different input signals in respective spatially different sound zones by means of a processor system. The method comprising 1) receiving spatial information, such as measured transfer functions, indicative of acoustic sound transmission between the plurality of loudspeaker positions and the sound zones, 2) receiving input indicative of signal characteristics of the input signals, such as signal statistics, such as power spectral densities or correlation matrices, 3) computing spatio-temporal correlation matrices in response to the spatial information, in response to the signal characteristics of the input signals, and in response to desired sound pressures in the plurality of sound zones, 4) computing a joint eigenvalue decomposition of the spatial correlation matrices, or at least an approximation thereof, to arrive at eigenvectors accordingly, 5) computing variable span filters formed from a linear combination of the eigenvectors in response to a desired trade-off between acoustic contrast and acoustic errors in the sound zones, and 6) generating one output filter for each of the plurality of loudspeakers, for each of the plurality of input signals, in accordance with the variable span filters.

Such method is advantageous compared to prior art methods for generating sound zones, since according to the inventors's insight, variable span filter can be used for formulation of an optimization problem which enables an easy way of incorporating a user trade-off between a measure of acoustic contrast between two zones and a measure of acoustic error in a zone. Thus, given the practical constraints of a limited number of loudspeakers, the loudspeaker positions in a room, the room acoustics, the definition of the sound zones etc., the method will provide the user with the possibility to prioritize optimization efforts to obtain a reasonable acoustic contrast versus error trade-off.

The method can be used for off-line computation of static output filters. Still, it is possible to take into account at least auditory perception effects such as spectral masking, based on general input regarding signal characteristics of the input signals. In more advanced embodiments, the output filters can be computed online in response to analysis of signal characteristics of the input signals, so as to take advantage of temporal variation of signal characteristics of the input signals. E.g. online computation can also be used to allow a user to change the acoustic contrast versus acoustic error trade-off by online entering a trade-off input at choice. Still further, the online computation can be performed dynamically in response to a user defined or otherwise dynamic definition of the sound zones.

For further information about variable span filters, reference is made to "Signal enhancement with variable Span linear filters", J. Benesty, Mads G. C., et al., 2016, ISBN 978-981-287-738-3.

Especially, the processor system may be implemented as a computer, a tablet, a smartphone, or a dedicated audio device with a processor capable of performing the required signal processing in real time. One device can be used to generate the output filters, e.g. a computer, while another device receives data indicative of the output filters and provides an audio interface for receipt of input signals and playback via the output filters accordingly.

In the following, preferred embodiments and features will be described.

The method may comprise determining for each of the sound zones a measure of auditory perception in response to the input indicative of signal characteristics of the input signals, and generating the output filters accordingly. Especially, said auditory perception for each of the sound zones is updated dynamically in response to real-time analysis of the input signals, such as involving a spectral analysis of the input signals. Especially, the auditory perception is applied as a weighting in step 3).

The generation of the output filter may be performed dynamically in response to analysis of the input signals, such as with a window length of 10-1000 ms, such as every 10-100 ms, such as every 30 ms.

The input indicative of signal characteristics of the input signals may be based on a general knowledge, such as power spectral density, of typical input signals.

The method of generating the output filters can be performed off-line. It can also be performed online, so as to allow dynamic updating of the output filters, e.g. in response to characteristics of the input signals or in response to other varying parameters, e.g. a user input indicating a desired trade-off between acoustic contrast and acoustic error.

The desired trade-off is preferably taken into account in step 5) by means of selecting a Lagrange multiplier value and by means of selecting a number of eigenvectors accordingly in a variable span control filter of the optimization problem.

In some embodiments, the method comprises receiving acoustic transfer functions for each of the combinations of loudspeaker positions and sound zones, wherein the sound zones are represented by at least one position. Especially, the method may comprise measuring acoustic transfer functions for each of the combinations of loudspeaker positions and sound zones. E.g. guiding a user in placing a microphone at various position so as to measure the relevant transfer function in the real life setup. As an alternative, the spatial information indicative of acoustic sound transmission between the plurality of loudspeaker positions and the sound zones are in the form of spatial information only, e.g. based on dimensions of a room and rough indications of loudspeaker and sound zone positions. More specifically, said spatial information may comprise spatial information of positions of acoustically relevant elements near the plurality of loudspeakers and the sound zones, such as walls, ceiling and floor etc.

Each sound zone may be represented by at least one spatial position, more preferably such as 2-20 spatially different positions, or even 20-100, or even more e.g. in case of large rooms and large sound zones.

The method may comprise receiving a trade-off input indicative of a desired minimum acoustic contrast and a desired maximum acoustic error in at least one of the sound zones in order to indicate a desired trade-off between acoustic contrast and acoustic error. Preferably, the method then comprises generating a variable span control filter in response to said trade-off input as a formulation of a constrained optimization problem. Preferably, the desired trade-off is taken into account in step 5) by means of selecting a value of a Lagrange multiplier and by means of selecting a number of eigenvectors accordingly in a control filter of the optimization problem. Specifically, the trade-off input may comprise a value indicative of a minimum sound pressure error in one sound zone and a maximum sound pressure level in another sound zone.

The computation of the eigenvectors in step 4) may be approximated by a Fourier transform, if preferred.

At least part of the processing in steps 3)-6) may be performed, such as performed solely, with data represented in the time domain. Alternatively, at least part of the processing in steps 3)-6) are performed, such as performed solely, with data represented in the frequency domain.

In one embodiment, the number of input signals is two, and wherein the number of sound zones is two. In another embodiment, the number of input signals is three or more, and wherein the number of sound zones is three or more.

The number of loudspeakers may be such as 4-10. If preferred, only 2 or 3 loudspeakers are used. The number of loudspeakers may also be 11 or more.

The input indicative of signal characteristics of the input signals may comprise information regarding spectral content of the input signals, such as a predicted average spectral content of expected typical types of input signals, e.g. power spectral density data.

The generated output filters may be in the form of FIR filters, e.g. each represented by 20-20000 taps, such as 20-2000 taps, which may depend on the desired precision and/or the properties of the physical setup.

The method may comprise performing a calibration procedure, before or after generation of the output filters. If performed after, the method preferably comprises performing a modification procedure to modify at least one of the output filters accordingly. Especially, said calibration procedure comprises applying a test audio signal as one of the input signals, playing said test audio signal via the plurality of loudspeakers using the generated output filters, and performing a recording of an acoustic response using a microphone positioned in at least one of the sound zones.

The method may comprise receiving the input signals with audio content, such as in the form of digital audio signals, and playing back the plurality of input signals via the plurality of loudspeakers using the generated output filters, thus generating sound zones in accordance with the generated output filters.

In a special application, e.g. room equalization, a plurality of positioned are used to define one single zone, in order to obtain output filter for obtaining an optimizing of spectral characteristics of sound within said single zone. Especially, such method comprise measuring transfer functions between loudspeaker positions and said plurality of positions defining the single zone with the loudspeakers at the desired positions in a room.

In a second aspect, the invention provides an audio device comprising a processor programmed to perform the method according to the first aspect.

In a third aspect, the invention provides a computer executable program code, or a programmable- or fixed hardware, and/or combination hereof, arranged to perform the method according to the second aspect, when executed on a processor. The computer executable program code may be stored on a data carrier and/or be available for downloading on the internet. The program code may be implemented to function on any type of processor platform.

In a fourth aspect, the invention provides a device comprising a processor programmed to perform the method according to the first aspect. Especially, the device comprises an audio interface configured to receive a plurality of input signals with audio content, and generating output signals accordingly via output filters obtained according to the method according to the first aspect, so as to generate sound zones. The device may comprise a processor programmed to perform the method according to any one of the first aspect.

In a fifth aspect, the invention provides a system comprising a device according to the fourth aspect, and a plurality of loudspeakers configured for receiving said output signals and generating an acoustic output accordingly.

In further aspects, the invention provides use of the method according to the first aspect for: a) generating sound zones in a car cabin, b) generating sound zones in a living room, c) generating sound zones in a public room, and d) generating sound zones in an outdoor environment. It is to be understood that these are non-exhaustive uses of the method of the first aspect.

It is appreciated that the same advantages and embodiments described for the first aspect apply as well for the further aspects. Further, it is appreciated that the described embodiments can be intermixed in any way between all the mentioned aspects.

BRIEF DESCRIPTION OF THE FIGURES

The invention will now be described in more detail with regard to the accompanying figures of which

The figures illustrate specific ways of implementing the present invention and are not to be construed as being limiting to other possible embodiments falling within the scope of the attached claim set.

DETAILED DESCRIPTION OF THE INVENTION

Figure 1:
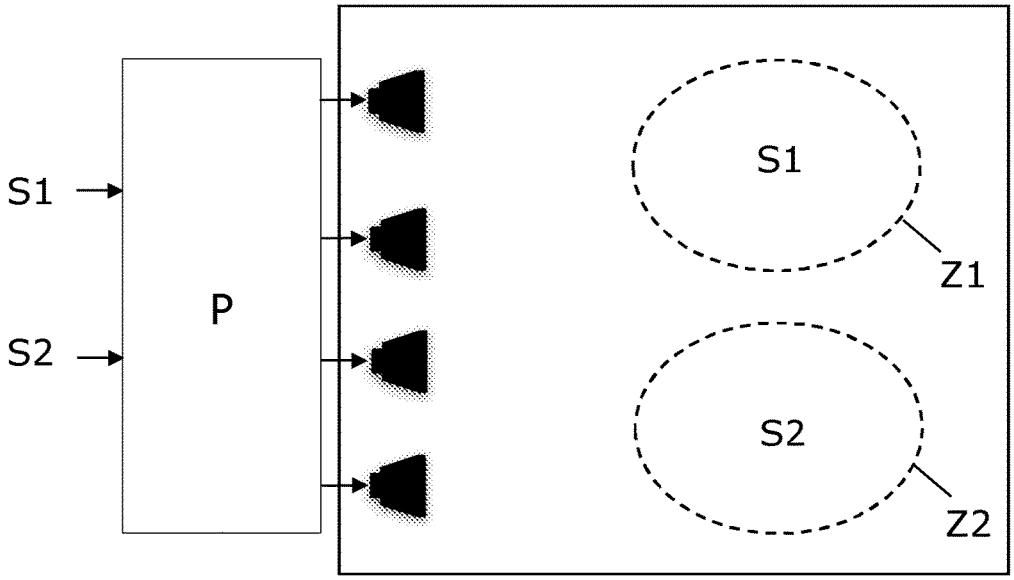
FIG. 1 illustrates the basic sound zone concept.

FIG. 1 illustrates the basic concept about generation of sound zones Z1, Z2 in one common acoustic environment, e.g. a room. Different sound input signals S1, S2 are processed in a processor P to generate output signals to a plurality of differently positioned loudspeakers generating acoustic outputs accordingly, here 4 are illustrated as an example. The purpose with the processor P is to process the sound input signals S1, S2 by output filters to each of the loudspeakers, one output filter per input signal per loudspeaker, trying to obtain the scenario that sound corresponding to S1 is primarily generated in zone Z1, while sound corresponding to S2 is primarily generated in zone Z2. Thus, zone Z1 is considered as bright zone for sound S1, while being dark zone for sound S1, and vice versa for zone Z2. The goal is to provide as high acoustic contrast between the zones Z1, Z2 as possible, and at the same time with as little sound distortion in the zones Z1, Z2 as possible. In practice, with a limited number of loudspeakers, a compromise or trade-off between acoustic contrast and sound distortion is required.

The present invention provides a method of generating the output filters of the processor P, providing the possibility to take as input, e.g. from a user, a trade-off between acoustic contrast and distortion. Further, the method according to the invention is suited for incorporating auditor perceptual weightings taking advantage of masking effects, so as to obtain a perceptually improved acoustic contrast and distortion performance.

Once the output filter are generated, the processor P can be seen as an audio device with an audio interface to receive the input signals and output the output signals to the loudspeakers accordingly. Especially, the device may have a user input control to allow the user to control trade-off between and adjust the output filters accordingly.

It is to be understood that the output filters may be generated on a computer and downloaded into a separate audio device implementing the output filters, or a computer or other special device may be capable of receiving inputs to allow generation of the output filters e.g. in response to measured data or generalized or computed data downloaded from a database etc., such as depending on the specific setup of loudspeakers and room, definition of sound zones etc.

Depending on the available processing power, the output filters can be real-time updated in response to the input signals, or the output filters can be computed off-line in response to statistics available for the input signals.

Figure 2:
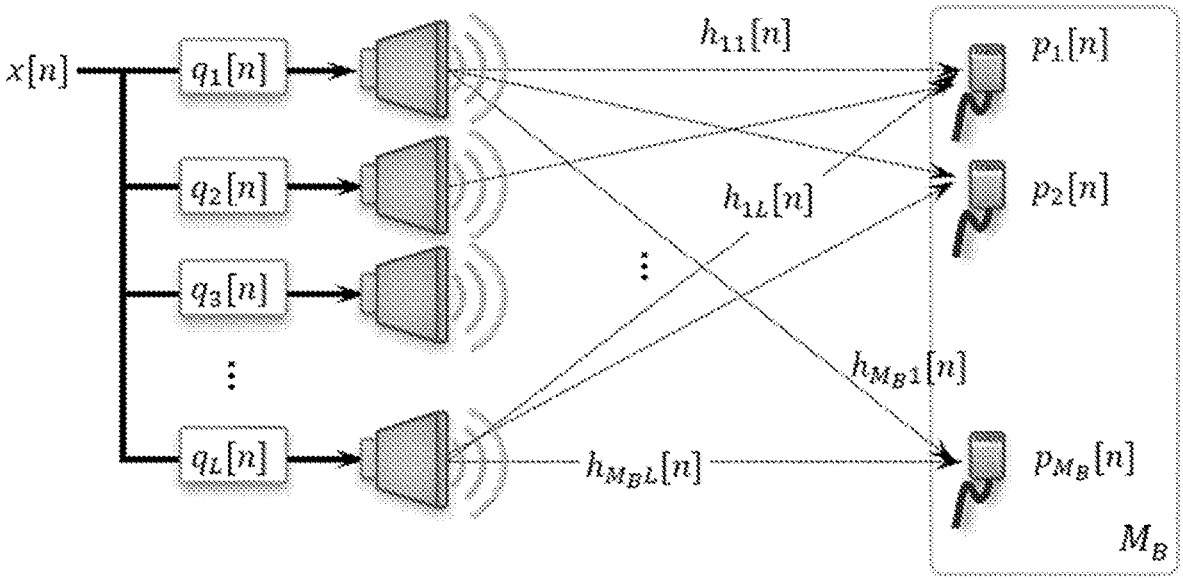
FIG. 2 illustrates in more details variables in a sound zone setup.

FIG. 2 shows the scenario in more details for one input signal x(n) as a function of discrete time n, for simplicity, illustrating the bright zone $M_B$. Each of the L loudspeakers are applied by the input signal x(n) via respective output filters q[n]. The various acoustic transfer functions h[n] between the loudspeaker outputs and pressure p[n] at receiver positions in the bright zone $M_B$ are illustrated. In general, the pressure $p_B$ in the bright zone can be expressed as:

$$p_B[n] = [p_1[n] \ \dots \ p_{M_B}[n]]^T$$
$$= [h_1^T \ \dots \ h_{M_B}^T]^T \mathbb{X}[n]q = H_B^T[n]q$$

Correspondingly, for the dark zone:

$$p_D[n]=H_D{}^T[n]q,$$

and for the total zone:

$$p_C[n] = \begin{bmatrix} p_B[n] \\ p_D[n] \end{bmatrix} = \begin{bmatrix} H_B^T[n] \\ H_D^T[n] \end{bmatrix} q = H_C^T[n]q, \text{ where}$$
$$H_B[n] = \mathbb{X}^T[n][h_1 \ \dots \ h_{M_B}] \quad \in \mathbb{R}^{LJ \times M_B}$$
$$H_D[n] = \mathbb{X}^T[n]h_1 \ \dots \ h_{M_D}] \quad \in \mathbb{R}^{LJ \times M_D}$$
$$q \in \mathbb{R}^{LJ \times 1}$$

Here, L is the number of loudspeakers, J is the length of the time-domain variable span filter, and M is the number of positions in a zone (specified by subscript B=bright zone, D=dark zone).

Thus, to compute the output filters q accordingly, an optimization problem must be formulated and solved. Once generated, e.g. in the form of Finite Impulse Response (FIR) filters, the output filters q can be used for playback of input signals via the loudspeakers to generate sound zones.

Figure 3:
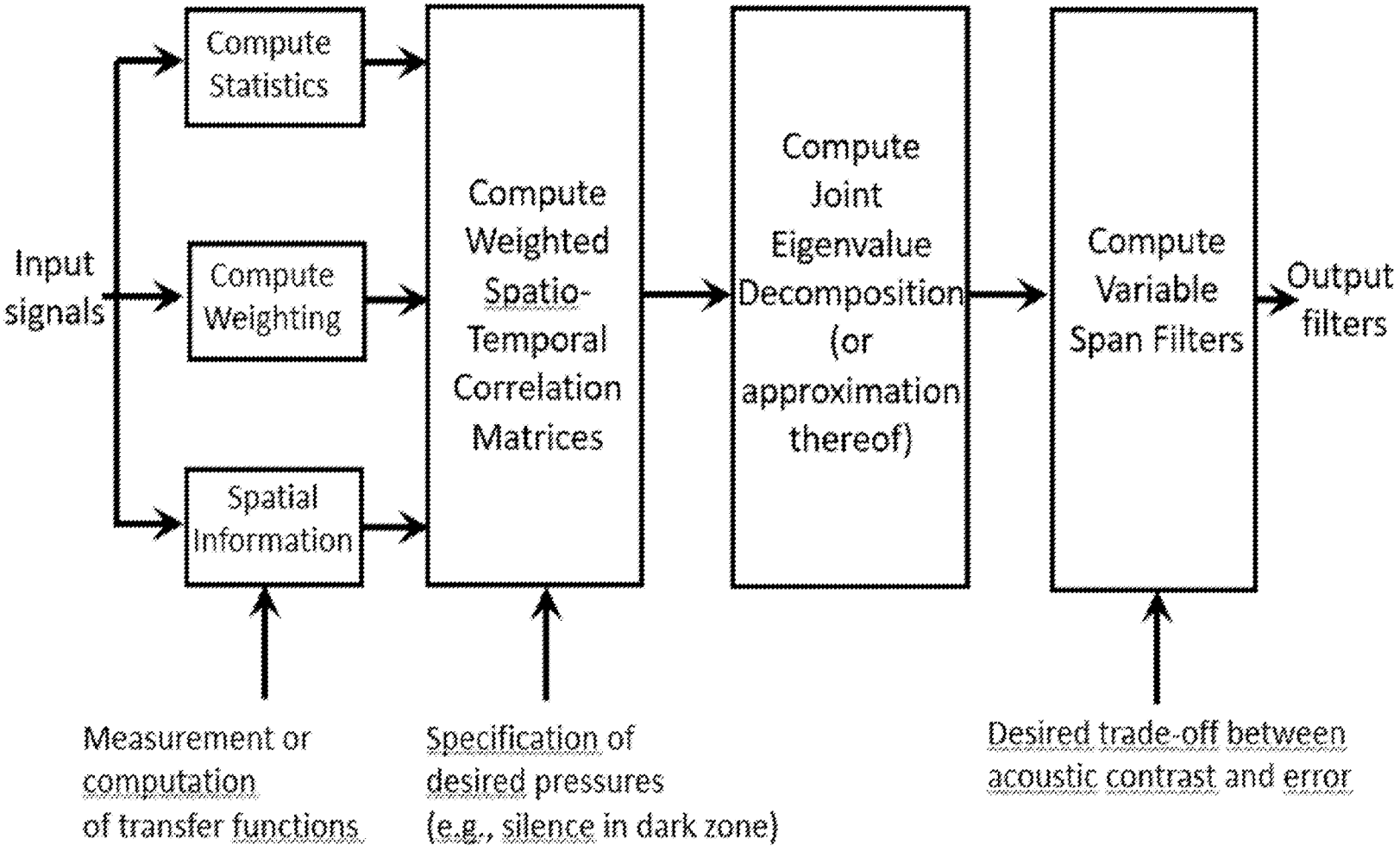
FIG. 3 illustrates a block diagram of elements of a method embodiment.

FIG. 3 illustrates in a block diagram of elements of a method embodiment of the invention for generating output filters. Spatial information, preferably in the form of measured or computer impulse response or transfer functions h are obtained indicative of acoustic sound transmission between the plurality of loudspeaker positions and the sound zones, as illustrated in FIG. 2. Here each sound zone is represented by one or more spatial positions, e.g. each zone is represented by averaged transfer functions h for several spatial positions in the zone. Statistics of the input signals such as power spectral densities (PSD) or correlation matrices are computed in real-time over a period of time for the input signal and updated online, or generated as general knowledge data for typical expected input signals.

To take into account auditory perceptual weighting, this can be implemented via a filtering of the sound reproduction error. Especially, reproduction error at the m'th receiver position can be described as:

$$\varepsilon_m[n]=w_m[n]*(d_m[n]-p_m[n]),$$

where $w_m$ is the auditory perceptual weighting. Especially, $w_m$ can be selected to be the inverse of the auditory masking threshold, which masking threshold may in the most advanced form be determined from a real-time analysis of the input signals and thus updated dynamically.

The sound reproduction error energy can be expressed as:

$$S_C = \frac{1}{N}\sum_{n=0}^{N-1}\|\varepsilon_C[n]\|^2 = \frac{1}{N}\sum_{n=0}^{N-1}\sum_{m=1}^{M_B+M_D}\varepsilon_m^2[n] = S_B + S_D,$$

where the signal distortion energy is:

$$S_B = \frac{1}{N}\sum_{n=0}^{N-1}\sum_{m=1}^{M_B}|w_m[n] * (d_m[n] - p_m[n])|^2,$$

and the residual energy is:

$$S_D = \frac{1}{N}\sum_{n=0}^{N-1}\sum_{m=1}^{M_D}|-w_m[n] * p_m[n]|^2.$$

In case such auditory perceptual weighting $w_m$, as just described, is applied, this will affect how the joint diagonalization in the following will be computed from the filtered/weighted quantities.

Based on the input signal an auditory perception weighting is computed, e.g. based on a real-time input signals, such as the input signals being analysed with windows of length 10-1000 ms. Such auditory perception weighting spectral and/or temporal masking effects. Hereby, it is possible to take into account auditory perception effect that for a person in a zone, the desired sound in this zone can be seen as a masker for interfering sound, i.e. desired sound from other zones. Thus, taking this into account, most preferably by real-time analysis of the input signals and corresponding real-time update of the output filters, an improved perceived acoustic contrast can be obtained.

Based on the above spatial information, auditory perception weighting, input signal statistics, and a desired specification of sound pressure (e.g. silence in the dark zone), spatio-temporal correlation matrices are computed in accordance to the explanation in relation to FIG. 2.

Next, joint eigenvalue decomposition of the spatio-temporal correlation matrices, or at least an approximation thereof, is performed in order to arrive at eigenvectors accordingly. Still following the annotation from FIG. 2 and explanation thereto, a generalized eigenvalue problem fan be formulated as:

$$R_B q = \lambda R_D q \text{ where } R_B, R_D \in \mathbb{R}^{LJ\times LJ}, \lambda = \kappa^{-2}\gamma, \text{ where}$$

$$R_B = \frac{1}{N}\sum_{n=0}^{N-1} H_B[n]H_B^T[n].$$

From this, LJ eigenvectors $U_{LJ}$ and eigenvalues $\Lambda_{LJ}$ can be computed so that $U_{LJ}$ jointly diagonalizes $R_B$, $R_D$. In other words, $R_B$ and $R_D$ can be expressed by $U_{LJ}$ and $\Lambda_{LJ}$. Such computations are known by the skilled person.

The invention is based on the insight, that the optimization problem of computing output filters q for the loudspeaker in a sound zone system can be formulated and solved by setting up a control filter based on a variable span filter see e.g. "Signal enhancement with variable Span linear filters", J. Benesty, Mads G. C., et al., 2016, ISBN 978-981-287-738-3. A desired trade-off between acoustic contrast and acoustic error or distortion can be used as input to computing variable span filters formed from a linear combination of the eigenvectors. The variable span filters are used then used solve the optimization problem, thereby resulting in one output filter for each of the plurality of loudspeakers, for each of the plurality of input signals. Especially, the variable span filters can be used to trade-off the sound reconstruction error in different zones, where the reconstructed sound is the desired sound minus an error. E.g. this can be used to minimize the pressure error in the bright zone, while the sound pressure level is below a chosen value in the dark zone.

Using a Lagrange multiplier μ, a VAriable Span Trade-off control filter can be formulated as:

$$q_{VAST} = U_V a_V(\mu) = U_V(\Lambda_V + \mu I_V)^{-1}U_V^T r_B = \sum_{v=1}^{V}\frac{u_v u_v^T}{\mu + \lambda_v} r_B$$

Here, the correlation vector $r_B$ is:

$$r_B = N^{-1}\Sigma_{n=0}^{N-1} H_B[n]d_B[n].$$

V is the number of eigenvectors and eigenvalues.

Both of V and μ can be used to control the optimization trade-off, and thus provides an easy way of influencing the resulting performance of the output filters to desired characteristics, given the available number of loudspeakers L.

Figure 4:
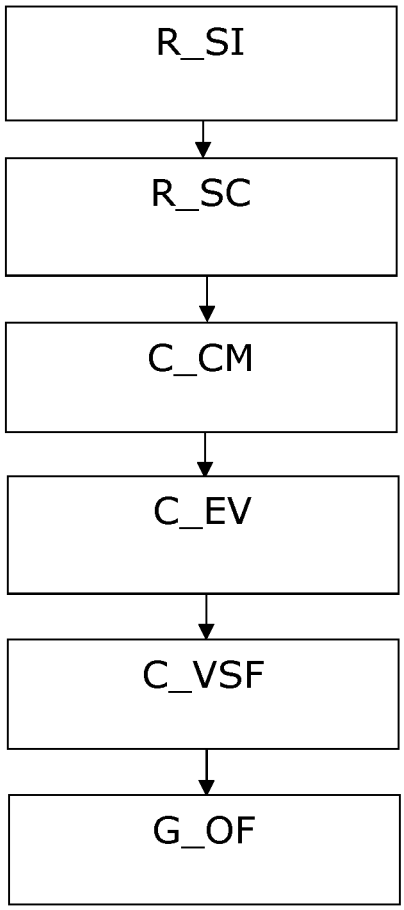
FIG. 4 illustrates steps of a method embodiment.

FIG. 4 shows steps of a method embodiment for generating output filters to a plurality of loudspeakers at respective positions for playback of a plurality of different input signals in respective spatially different sound zones by means of a processor system. Step 1) is receiving R_SI spatial information indicative of acoustic sound transmission between the plurality of loudspeaker positions and the sound zones. This can be done including a step of measuring transfer functions between actual loudspeaker positions and one or more positions indicating each of the sound zones in a room. Step 2) is receiving R_SC input indicative of signal characteristics of the input signals. This can be done in the form of power spectral densities or correlation matrices for typical input signals, e.g. typical data for speech, music, or a mix thereof. Step 3) is computing C_CM spatio-temporal correlation matrices in response to the spatial information, in response to the signal characteristics of the input signals, and in response to desired sound pressures in the plurality of sound zones (e.g. silence in dark zone(s)). In case of measured transfer functions, these are used. In case of more generalized graphical data indicative of the physical positions of sound zones, the acoustic environment, and the loudspeaker positions therein, database transfer functions can be used, or simulated room impulse responses can be calculated using room acoustic simulation software.

Next step is computing C_EV a joint eigenvalue decomposition of the spatial correlation matrices, as known by the skilled person to arrive at eigenvectors accordingly. Especially, various approximations to exact solutions can be used, if preferred.

Next step is computing C_VSF variable span filters formed from a linear combination of the eigenvectors in response to a desired trade-off between acoustic contrast and acoustic errors in the sound zones. Especially, this can be done in response to a user input, where a user can input a desired acoustic contrast versus acoustic error trade-off to influence the resulting output filers.

The final step is generating G_OF one output filter for each of the plurality of loudspeakers, for each of the plurality of input signals, in accordance with the variable span filters. These output filters can then be used for filtering audio input signals in order to generate audio output signals to be reproduced via loudspeaker in order to generate sound zones with different sound. Depending on the desired precision and depending on the acoustic environment of the sound zone setup, the resulting output filters can each be represented by FIR filters with the desired number of taps.

Figure 5:
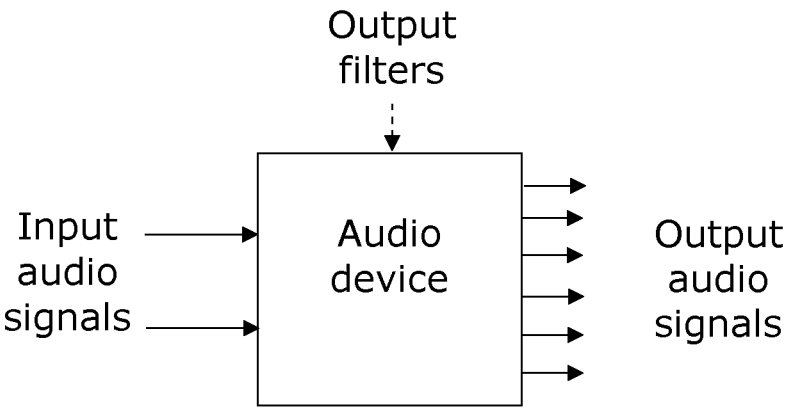
FIG. 5 illustrates a block diagram of a device embodiment.

FIG. 5 shows a block diagram of a device embodiment. An audio device with an audio input and output interface is capable of receiving a set of output filters, e.g. data representing FIR filter coefficients, which have been generated according to the method described in the forgoing. The audio device is then capable of generating a plurality of audio input signals, real-time filtering the audio input signals with the received output filters, and providing a set of audio output signals accordingly. The audio output signals are suited for being received and converted to acoustic signals by respective loudspeakers, either in a wired or wireless format. The output filters can be either generated by the user's own computer, or they can be generated at a server and provided for downloading to the audio device via the internet.

In general, it is to be understood that the invention is applicable both in situations where one input signal is intended to be heard in one zone, but also in cases where e.g. two input signals, e.g. a set of stereo audio signals, are intended to be heard in one zone. Thus, in general the invention is applicable for multi-channel audio, e.g. surround sound system etc.

In a special application, the method according to the invention can be used for equalizing a setup of one or more loudspeakers in a room. For this, only one sound zone is defined, and a number of positions are defined therein, where an optimization problem similar to the one described above in general, using variable span filter, can setup and solved to arrive at output filters to provide a given desired spectral sound characteristic within a defined zone.

The invention has a plurality of applications where a high degree of acoustic contrast between different sound zones is desired, i.e. where different person want to be together in one common environment but listening to different sound input signals. E.g. in a living room, one watching/listening TV, while another one listens to sound from another audio source. This may be even more pronounced in a car cabin. In a museum, one language narrative speech can be played in one zone, while one or more other zones can dedicated to other language narrative speech at the same time. The invention can be used in outdoor setups, e.g. for generating acoustic contrast in simultaneous multi-concert environments.

The invention in general solves the problem of providing a framework for generating output filters in a way that allows a user to setup a trade-off or compromise between acoustic contrast and acoustic error introduced, in a given setup of loudspeakers in a given environment.

To sum up: the invention provides a method for generating output filters to a plurality of loudspeakers at respective positions for playback of a plurality of different input signals in respective spatially different sound zones by means of a processor system. The method comprising computing spatio-temporal correlation matrices in response to spatial information, e.g. measured transfer functions, and in response to desired sound pressures in the plurality of sound zones. Joint eigenvalue decomposition of the spatial correlation matrices are then computed, or at least an approximation thereof, to arrive at eigenvectors accordingly. Next, variable span filters are formed from a linear combination of the eigenvectors in response to a desired trade-off between acoustic contrast and acoustic errors in the sound zones. Finally, output filter for each of the plurality of loudspeakers, for each of the plurality of input signals, in accordance with the variable span filters. The method is applicable also for optimization in one zone, e.g. for room equalization.

Although the present invention has been described in connection with the specified embodiments, it should not be construed as being in any way limited to the presented examples. The scope of the present invention is to be interpreted in the light of the accompanying claim set. In the context of the claims, the terms "including" or "includes" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A method for generating output filters to a plurality of loudspeakers at respective positions for playback of a plurality of different input signals in respective spatially different sound zones by a processor system, the method comprising:

receiving spatial information, indicative of acoustic sound transmission between the plurality of loudspeaker positions and the sound zones, receiving input indicative of signal characteristics of the input signals, computing spatio-temporal correlation matrices in response to the spatial information, in response to the signal characteristics of the input signals, and in response to desired sound pressures in the plurality of sound zones, computing a joint eigenvalue decomposition of the spatial correlation matrices, to arrive at eigenvectors accordingly, computing variable span filters formed from a linear combination of the eigenvectors in response to a desired trade-off between acoustic contrast and acoustic errors in the sound zones, allowing a user to change the acoustic contrast versus an acoustic error trade-off by entering a trade-off input, and generating one output filter for each of the plurality of loudspeakers, for each of the plurality of input signals, in accordance with the variable span filters.

2. The method according to claim 1, further comprising determining for each of the sound zones a measure of auditory perception in response to the input indicative of signal characteristics of the input signals, and generating the output filters accordingly.

3. The method according to claim 2, wherein the auditory perception for each of the sound zones is updated dynamically in response to real-time analysis of the input signals.

4. The method according to claim 2, wherein the auditory perception is applied as a weighting.

5. The method according to claim 1, wherein the generation of the output filter is performed dynamically in response to analysis of the input signals.

6. The method according to claim 1, wherein the input indicative of signal characteristics of the input signals is based on a general knowledge of typical input signals.

7. The method according to claim 1, wherein the method of generating the output filters is performed off-line.

8. The method according to claim 1, wherein the desired trade-off is taken into account by selecting a Lagrange multiplier value and selecting a number of eigenvectors accordingly in a control filter of a optimization problem.

9. The method according to claim 1, comprising receiving acoustic transfer functions for each of the combinations of loudspeaker positions and sound zones, wherein the sound zones are represented by at least one position.

10. The method according to claim 9, wherein each sound zone is represented by at least one spatial position.

11. The method according to claim 1, further comprising receiving a trade-off input indicative of a desired minimum acoustic contrast and a desired maximum acoustic error in at least one of the sound zones in order to indicate desired trade-off between acoustic contrast and acoustic error.

12. The method according to claim 11, wherein the trade-off input comprises a value indicative of a minimum sound pressure error in one sound zone and a maximum sound pressure level in another sound zone.

13. The method according to claim 1, wherein the eigenvectors are approximated by a Fourier transform.

14. The method according to claim 1, wherein at least part of the method is performed with data represented in a time domain.

15. The method according to claim 1, wherein at least part of the method is performed with data represented in a frequency domain.

16. The method according to claim 1, wherein the input indicative of signal characteristics of the input signals comprises information regarding spectral content of the input signals.

17. The method according to claim 1, further comprising performing a calibration procedure after generation of the output filters, and performing a modification procedure to modify at least one of the output filters accordingly.

18. A device for generating output filters to a plurality of loudspeakers at respective positions for playback of a plurality of different input signals in respective spatially different sound zones, comprising:

a memory configured to store computer program instructions; and a processor configured to perform the computer program instructions to:

receive spatial information, indicative of acoustic sound transmission between the plurality of loudspeaker positions and the respective sound zones, receive input indicative of signal characteristics of the input signals, compute spatio-temporal correlation matrices in response to the spatial information, in response to the signal characteristics of the input signals, and in response to desired sound pressures in the plurality of sound zones, compute a joint eigenvalue decomposition of the spatial correlation matrices, to arrive at eigenvectors accordingly, compute variable span filters formed from a linear combination of the eigenvectors in response to a desired trade-off between acoustic contrast and acoustic errors in the sound zones, allow a user to change the acoustic contrast versus an acoustic error trade-off by entering a trade-off input, and generate one output filter for each of the plurality of loudspeakers, for each of the plurality of input signals, in accordance with the variable span filters.

19. A system for generating output filters to a plurality of loudspeakers at respective positions for playback of a plurality of different input signals in respective spatially different sound zones, comprising:

a device configured to:

receive spatial information, indicative of acoustic sound transmission between the plurality of loudspeaker positions and the sound zones, receive input indicative of signal characteristics of the input signals, compute spatio-temporal correlation matrices in response to the spatial information, in response to the signal characteristics of the input signals, and in response to desired sound pressures in the plurality of sound zones, compute a joint eigenvalue decomposition of the spatial correlation matrices, to arrive at eigenvectors accordingly, compute variable span filters formed from a linear combination of the eigenvectors in response to a desired trade-off between acoustic contrast and acoustic errors in the sound zones, allow a user to change the acoustic contrast versus an acoustic error trade-off by entering a trade-off input, and generate one output filter for each of the plurality of loudspeakers, for each of the plurality of input signals, in accordance with the variable span filters; and a plurality of loudspeakers configured to receive the signals and generating an acoustic output accordingly.

20. The method according to claim 1, further comprising:

generating sound zones in a car cabin, in a living room, in a public room or in an indoor environment.

* * * * *